US011342677B2

(12) United States Patent
Cao et al.

(10) Patent No.: US 11,342,677 B2
(45) Date of Patent: May 24, 2022

(54) BALANCED DIPOLE UNIT AND BROADBAND OMNIDIRECTIONAL COLLINEAR ARRAY ANTENNA

(71) Applicant: Norsat International Inc., Richmond (CA)

(72) Inventors: Yazi Cao, Shenzhen (CN); Jan Koivunen, Shenzhen (CN); Tong Li, Shenzhen (CN)

(73) Assignee: NORSAT INTERNATIONAL INC., Richmond (CA)

( * ) Notice: Subject to any disclaimer, the term of this patent is extended or adjusted under 35 U.S.C. 154(b) by 183 days.

(21) Appl. No.: 16/362,228

(22) Filed: Mar. 22, 2019

(65) Prior Publication Data

US 2019/0296441 A1 Sep. 26, 2019

(30) Foreign Application Priority Data

Mar. 23, 2018 (CN) ..... 201810246989.2

(51) Int. Cl.
*H01Q 21/10* (2006.01)
*H01Q 9/06* (2006.01)
(Continued)

(52) U.S. Cl.
CPC ..... *H01Q 9/065* (2013.01); *H01Q 1/38* (2013.01); *H01Q 5/15* (2015.01); *H01Q 5/364* (2015.01);
(Continued)

(58) Field of Classification Search
CPC ..... H01Q 9/065; H01Q 1/38; H01Q 9/285; H01Q 5/364; H01Q 9/26; H01Q 5/15;
(Continued)

(56) References Cited

U.S. PATENT DOCUMENTS 5,821,902 A 10/1998 Keen
5,990,845 A * 11/1999 Sharp ..... H01Q 21/205 343/778

(Continued)

FOREIGN PATENT DOCUMENTS

CN 102104203 A 6/2011

OTHER PUBLICATIONS

Search Report from European Patent Application No. 19164668.6 dated Aug. 23, 2019.

*Primary Examiner* — David E Lotter

(74) *Attorney, Agent, or Firm* — Calfee Halter & Griswold LLP

(57) ABSTRACT

The present invention provides a balanced dipole unit and a broadband omnidirectional collinear array antenna formed by the balanced dipole unit. Balanced dipole unit circuits in the balanced dipole unit are symmetrically distributed on two sides of a circuit carrier, and a feeder and a ground wire in the balanced dipole unit are also symmetrically distributed, so that the balanced dipole unit has a completely symmetrical structure. A principle of the symmetrical structure is the same as a differential design principle and a self-balancing principle in the circuit design, thereby reducing current coupling between the balanced dipole units and eliminating the need of using an additional choke circuit when a broadband omnidirectional collinear array antenna is formed by the balanced dipole unit.

18 Claims, 8 Drawing Sheets

(51) Int. Cl.

| | |
|---|---|
| ***H01Q 5/15*** | (2015.01) |
| ***H01Q 9/16*** | (2006.01) |
| ***H01Q 21/20*** | (2006.01) |
| ***H01Q 1/38*** | (2006.01) |
| ***H01Q 9/28*** | (2006.01) |
| ***H01Q 5/364*** | (2015.01) |
| ***H01Q 9/26*** | (2006.01) |

(52) U.S. Cl.
CPC ..... *H01Q 9/16* (2013.01); *H01Q 9/26* (2013.01); *H01Q 9/285* (2013.01); *H01Q 21/10* (2013.01); *H01Q 21/205* (2013.01)

(58) Field of Classification Search
CPC ..... H01Q 9/16; H01Q 21/10; H01Q 21/205; H01Q 1/50; H01Q 21/24
See application file for complete search history.

(56) References Cited

U.S. PATENT DOCUMENTS

| | | | | |
|---|---|---|---|---|
| 2002/0180644 | A1* | 12/2002 | Carson | H01Q 21/08 343/700 MS |
| 2006/0033666 | A1* | 2/2006 | Su | H01Q 9/0414 343/700 MS |
| 2007/0040758 | A1* | 2/2007 | Dwyer | H01Q 21/062 343/792 |
| 2007/0241984 | A1 | 10/2007 | Schadler | |
| 2011/0043424 | A1 | 2/2011 | Lee et al. | |
| 2012/0086620 | A1 | 4/2012 | Johnson | |
| 2016/0294065 | A1* | 10/2016 | Lindmark | H01Q 13/10 |
| 2018/0062731 | A1* | 3/2018 | Ng | H01Q 9/285 |

* cited by examiner

BALANCED DIPOLE UNIT AND BROADBAND OMNIDIRECTIONAL COLLINEAR ARRAY ANTENNA

CROSS-REFERENCE TO RELATED APPLICATIONS

This application claims priority to Chinese Patent Application No. 201810246989.2, filed Mar. 23, 2018, the entire content of which is incorporated herein by reference.

TECHNICAL FIELD

The present invention belongs to the field of antenna technologies, and more specifically, relates to a balanced dipole unit and a broadband omnidirectional collinear array antenna.

BACKGROUND

With the development of mobile communication technologies, a broadband omnidirectional collinear array antenna with omnidirectional radiation function is widely used, such as the broadband omnidirectional collinear array antenna used in a wireless communication system, and in order to improve the radiation gain and efficiency of the broadband omnidirectional collinear array antenna, additional choke circuit such as a current regulator needs to be used in the broadband omnidirectional collinear array antenna, or a spacing between each radiating unit in the broadband omnidirectional collinear array antenna is increased, so as to improve the radiation gain and efficiency of the broadband omnidirectional collinear array antenna through reducing the current coupling between the units.

However, the method above of using the current regulator or increasing the spacing between each radiating unit in the broadband omnidirectional collinear array antenna may increase a length of the broadband omnidirectional collinear array antenna, and the method of using the current regulator or increasing the spacing between each radiating unit in the broadband omnidirectional collinear array antenna cannot reduce the influence of the metal supporting member in the broadband omnidirectional collinear array antenna on the broadband omnidirectional collinear array antenna. In addition, how to obtain a wider working bandwidth under a limited size is also one of the design difficulties of the broadband omnidirectional collinear array antenna.

SUMMARY

The present subject matter provides a balanced dipole unit and a broadband omnidirectional collinear array antenna for reducing a length of the broadband omnidirectional collinear array antenna, thereby realizing a wider working bandwidth and reducing the interference of a metal supporting member in the broadband omnidirectional collinear array antenna to the broadband omnidirectional collinear array antenna. The technical solutions are as follows.

The present invention provides a balanced dipole unit, wherein the balanced dipole unit includes: a circuit carrier, a balanced dipole unit circuit, a feeder and a ground wire;

the balanced dipole unit circuits are symmetrically distributed on two planes of the circuit carrier; and the feeder and the ground wire are connected to the balanced dipole unit circuit, and the feeder and the ground wire are symmetrically distributed in the balanced dipole unit.

It can be known from the technical solution above that the balanced dipole unit circuit in the balanced dipole unit is symmetrically distributed on two sides of the circuit carrier, and the feeder and ground wire in the balanced dipole unit are also symmetrically distributed, so that the balanced dipole unit has the symmetrical structure, and the principle of the symmetrical structure of the balanced dipole unit is the same as the differential design principle and the self-balancing principle in the circuit design, thereby reducing current coupling between the balanced dipole units and eliminating the need of using an additional choke circuit when the broadband omnidirectional collinear array antenna is formed by the balanced dipole unit, so as to greatly reduce the length of the broadband omnidirectional collinear array antenna, and the symmetrical structure of the balanced dipole unit may also reduce an interference of the metal supporting member, so as to reduce the influence of the metal supporting member on the broadband omnidirectional collinear array antenna when the broadband omnidirectional collinear array antenna is formed by the balanced dipole unit. In addition, by introducing an open slot into the balanced dipole unit circuit, the current distribution of the balanced dipole unit circuit can be changed to generate a plurality of resonance frequency points, and the working bandwidth of the broadband omnidirectional collinear array antenna formed by the balanced dipole unit is improved.

BRIEF DESCRIPTION OF THE DRAWINGS

In order to more clearly illustrate the technical solutions in the embodiments of the present invention or the prior art, the drawings to be used in the embodiments or the description of the prior art will be briefly introduced below. Obviously, the drawings in the following description merely indicate some embodiments of the present invention, and those skilled in the art can further obtain other drawings according to these drawings without going through any creative work.

DETAILED DESCRIPTION

In order to make the object, technical solution and advantages of the embodiments of the present invention clearer, the technical solution in the embodiments of the present invention will be described clearly and completely below with reference to the drawings in the embodiments of the present invention. Obviously, the embodiments described are a part of the embodiments of the present invention instead of all embodiments. Based on the embodiments in the present invention, all other embodiments obtained by those skilled in the art on the premise of not going through creative works belong to the protection scope of the present invention.

Figure 1:
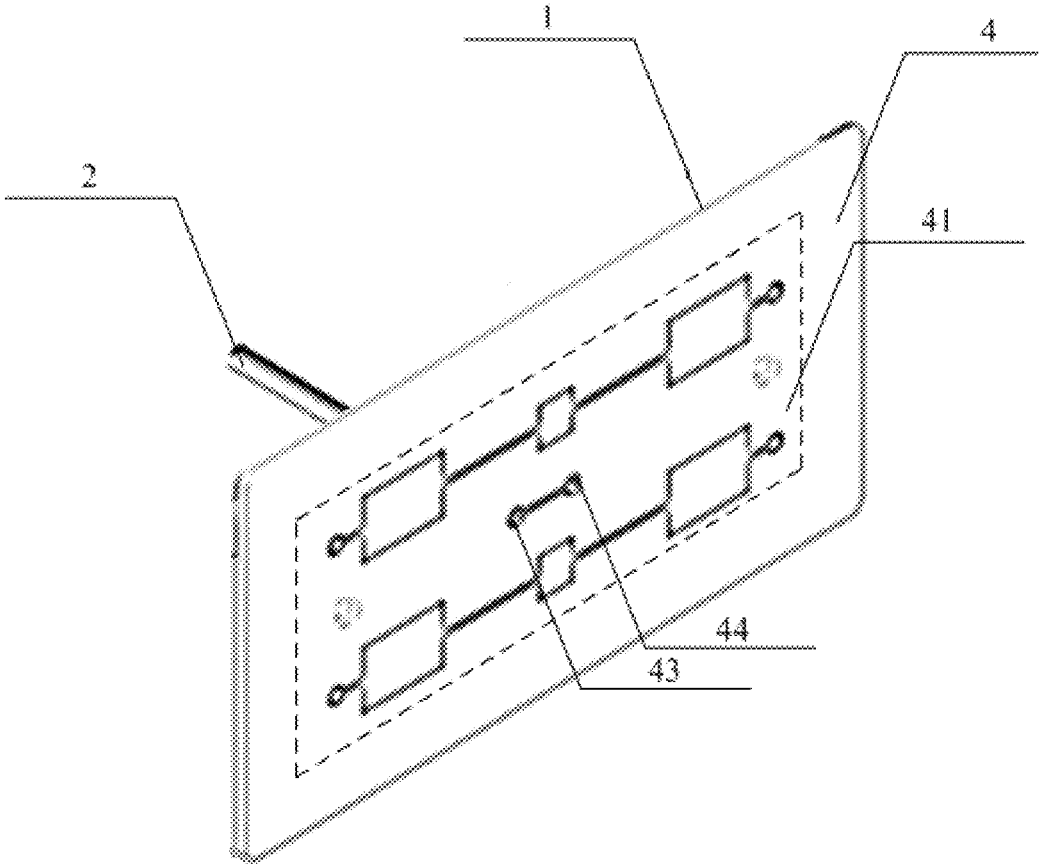
FIG. 1 is a front diagram of a balanced dipole unit provided by an embodiment of the present invention.
Figure 2:
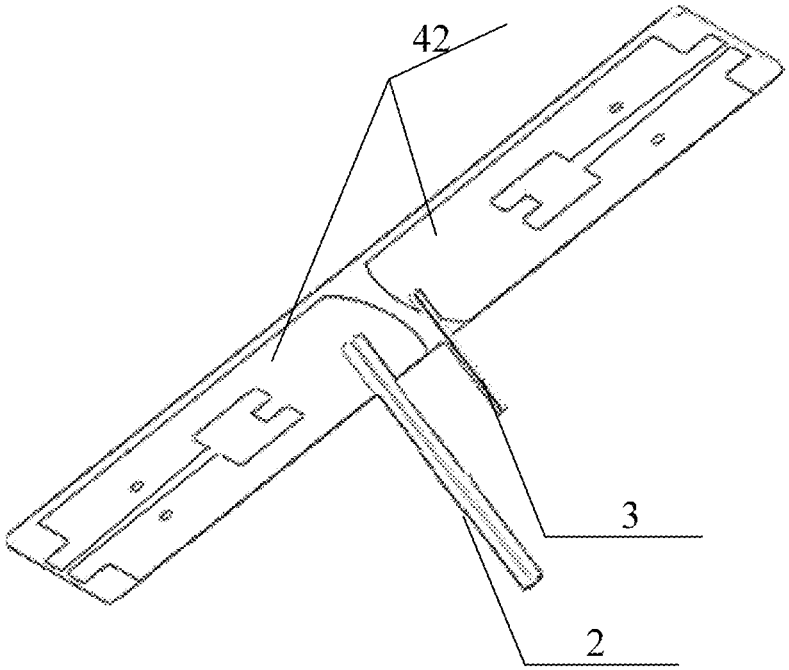
FIG. 2 is a back diagram of the balanced dipole unit provided by the embodiment of the present invention.

FIG. 1 shows a front diagram of a balanced dipole unit provided by an embodiment of the present invention, FIG. 2 shows a back diagram of the balanced dipole unit provided by the embodiment of the present invention. From the front and the back of the balanced dipole unit shown in FIG. 1 and FIG. 2, it can be known that the balanced dipole unit has a symmetrical structure, and a principle of the symmetrical structure is the same as a differential design principle and a self-balancing principle in the circuit design, thereby reducing current coupling between the balanced dipole units and reducing the interference of a metal supporting member, so as to reduce a length of a broadband omnidirectional collinear array antenna and reduce an influence of the metal supporting member on the broadband omnidirectional collinear array antenna. The balanced dipole unit shown in FIG. 1 and FIG. 2 in combination may include: a circuit carrier 1, a feeder 2, a ground wire 3 and a balanced dipole unit circuit 4.

The balanced dipole unit circuit 4 is symmetrically arranged on both sides of the circuit carrier 1 as shown in FIG. 1 and FIG. 2, the balanced dipole unit circuit 4 includes a first circuit portion 41 (the portion included in a dotted box shown in FIG. 1) and a second circuit portion 42, the first circuit portion 41 is symmetrically arranged on the front of the circuit carrier 1 (FIG. 1 shows the front of the circuit carrier 1) and the second circuit portion 42 is symmetrically arranged on the back of a circuit carrier 1 (FIG. 2 shows the back of the circuit carrier 1), and the balanced dipole unit may be used as a radiating unit of the broadband omnidirectional collinear array antenna through the first circuit portion 41 and the second circuit portion 42.

It can be known from FIG. 1 that a feasible method for symmetrically arranging the first circuit portion 41 on the front of the circuit carrier 1 is that: the first circuit portion 41 includes three antenna circuit lines which are sequentially symmetrically arranged on the front of the circuit carrier 1, for example, one antenna circuit line in the three antenna circuit lines overlaps with a center line of the circuit carrier 1, the remaining two antenna circuit lines are symmetrically distributed based on the antenna circuit line overlapping with the center line, and each antenna circuit line is respectively parallel to the antenna circuit line overlapping with the center line, so that each antenna circuit line is respectively parallel to the center line of the circuit carrier 1.

In addition, the three antenna circuit lines themselves may also be a symmetrical circuit line in addition to the symmetrical distribution of the three antenna circuit lines, for example, in FIG. 1, the three antenna circuit lines are each symmetrical based on a vertical line perpendicular to the center line of the front of the circuit carrier 1, so that the three antenna circuit lines are not only symmetrical to themselves, but also mutually symmetrical to each other.

It can be known from FIG. 2 that a feasible method for symmetrically arranging the second circuit portion 42 on the back of the circuit carrier 1 is that: the second circuit portion 42 includes a first sub-circuit and a second sub-circuit, the first sub-circuit and the second sub-circuit are symmetrically distributed based on a point on the back of the circuit carrier 1, which is a center point on the back of the circuit carrier 1 shown in FIG. 2, and in addition to the symmetrical distribution between each sub-circuit in the second circuit portion 42, each sub-circuit itself may also be a symmetrical circuit, and as shown in FIG. 2, each sub-circuit is symmetrical based on the center line on the back of the circuit carrier 1. Moreover, the first sub-circuit and the second sub-circuit may form a closed loop circuit through the antenna circuit line in the first circuit portion 41, so that the balanced dipole unit may be used as a radiating unit of the broadband omnidirectional collinear array antenna.

One point needing to be explained here is that: FIG. 1 and FIG. 2 are merely exemplary illustration, the balanced dipole unit provided in the embodiment is not limited to the symmetrical distribution shown in FIG. 1 and FIG. 2, and the balanced dipole unit circuit 4 is also not limited to the structure shown in FIG. 1 and FIG. 2.

The feeder 2 and the ground wire 3 are symmetrically distributed in the balanced dipole unit, for example, the feeder 2 and the ground wire 3 are symmetrically distributed around a point in the circuit carrier 1, such as the center point in the circuit carrier 1 as a reference point, and in the embodiment, the feeder 2 and the ground wire 3 are connected to the balanced dipole unit circuit, for example, the feeder 2 is connected to a feed point in the balanced dipole unit circuit 4 for feeding for a radio frequency signal in the balanced dipole unit circuit 4, so that the radio frequency signal may be radiated when the balanced dipole unit is used as a radiating unit of the broadband omnidirectional collinear array antenna, the ground wire 3, and the ground wire 3 is connected to a short-circuit point in the balanced dipole unit circuit 4 for enabling the balanced dipole unit circuit 4 to be grounded through the ground wire 3. In FIG. 1, 43 is the feed point in the balanced dipole unit circuit 4 and 44 is the short-circuit point in the balanced dipole unit circuit 4, it can be known from FIG. 1 that the feed point and the short-circuit point in the balanced dipole unit circuit 4 are also symmetrically distributed, so that the balanced dipole unit circuit 4 is a circuit with a symmetrical structure.

In the embodiment, the circuit carrier 1 may adopt, but is not limited to adopt a printed circuit board or a metal stamping part, when the circuit carrier 1 adopts the printed circuit board, the printed circuit board may be a dielectric substrate, and the balanced dipole unit circuit 4 may be printed on the printed circuit board by printing. When the circuit carrier 1 adopts the metal stamping part, the balanced dipole unit circuit 4 may be stamped on the metal stamping part by stamping. When the balanced dipole unit shown in FIG. 1 and FIG. 2 constitutes the broadband omnidirectional collinear array antenna, a matching number of balanced dipole units are selected according to an antenna gain requirement of the broadband omnidirectional collinear array antenna, and the selected balanced dipole units are assembled.

It can be known from the technical solution above that the balanced dipole unit circuit in the balanced dipole unit is symmetrically distributed on two sides of the circuit carrier, and the feeder and ground wire in the balanced dipole unit are also symmetrically distributed, so that the balanced dipole unit has a symmetrical structure, and the principle of the symmetrical structure of the balanced dipole unit is the same as the differential design principle and the self-balancing principle in the circuit design, thereby reducing current coupling between the balanced dipole units and eliminating the need of using an additional choke circuit when the broadband omnidirectional collinear array antenna is formed by the balanced dipole unit, so as to greatly reduce a length of the broadband omnidirectional collinear array antenna, and the symmetrical structure of the balanced dipole unit may also reduce an influence of a metal supporting member on the broadband omnidirectional collinear array antenna. In addition, the balanced dipole unit provided by the embodiment is modularized, so that when the balanced dipole unit constitutes the broadband omnidirectional collinear array antenna, the balanced dipole unit may be selected and assembled according to the antenna gain requirement, thereby saving manufacturing cost and reducing tuning time and assembly time.

Figure 3:
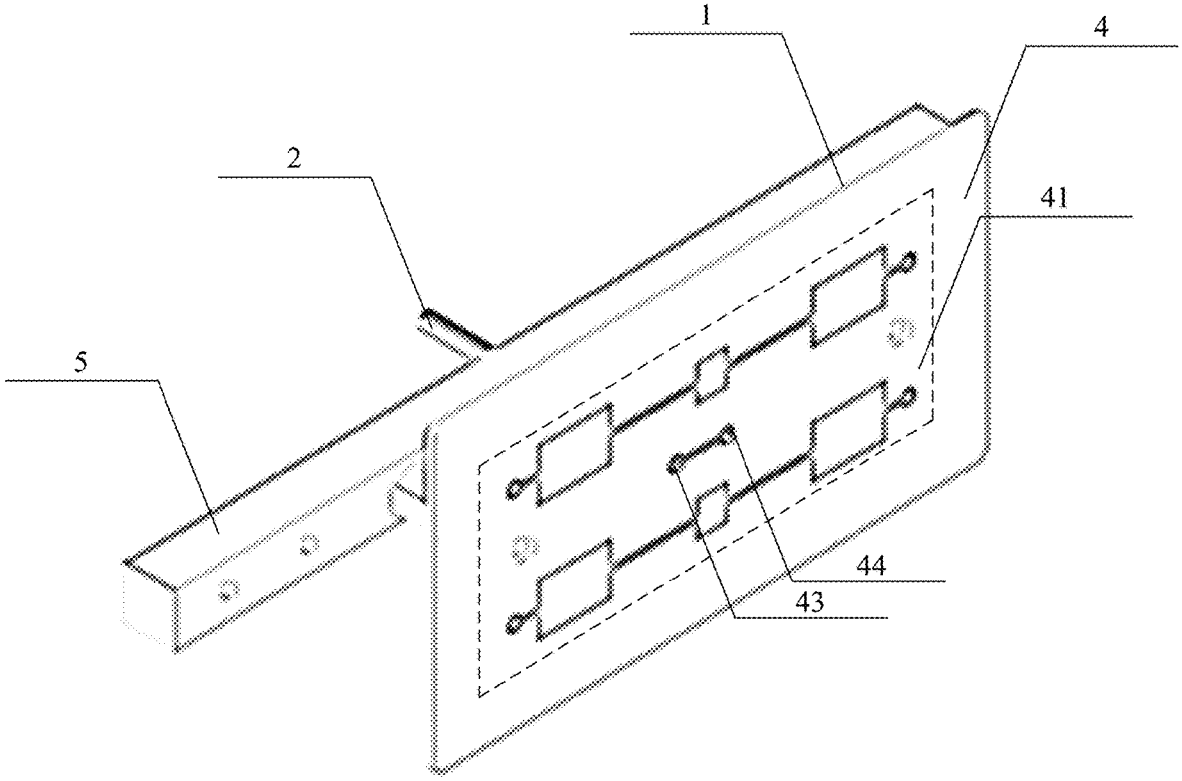
FIG. 3 is a front diagram of another balanced dipole unit provided by an embodiment of the present invention.
Figure 4:
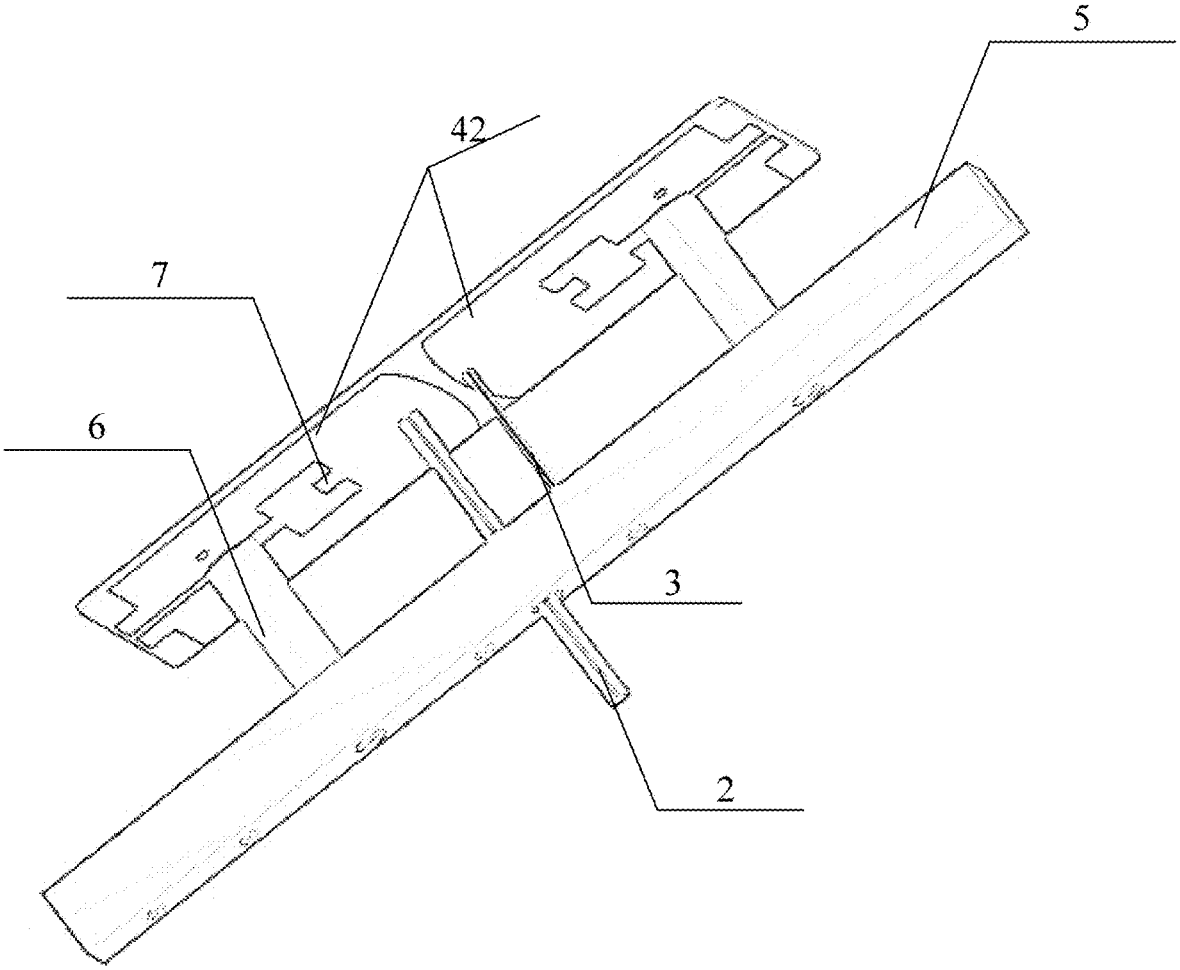
FIG. 4 is a back diagram of another balanced dipole unit provided by the embodiment of the present invention.

FIG. 3 shows a front diagram the other balanced dipole unit provided by the embodiments of the present invention, FIG. 4 shows a back diagram of the other balanced dipole unit provided by the embodiments of the present invention, based on the balanced dipole unit with the symmetrical structure, the balanced dipole unit may further include a metal supporting member 5 and at least one non-metal fixing member 6, wherein the circuit carrier 1 is connected to the metal supporting member 5 through at least one non-metal fixing member 5, so that the circuit carrier 1 may be fixed on the metal supporting member 5. As shown in FIG. 3, the circuit carrier 1 may be fixed by two non-metal fixing members 6 symmetrically distributed in the balanced dipole unit, so that the balanced dipole unit may be used as an independent radiating unit, that is to modularize the balanced dipole unit, and in this way, the broadband omnidirectional collinear array antenna may be obtained through combining a plurality of balanced dipole units, for example, one broadband omnidirectional collinear array antenna may be obtained through combining the metal supporting members 5 in multiple balanced dipole units. Moreover, the circuit carrier 1 is fixed through symmetrically distributed non-metal fixing member 6, so that the non-metal fixing member 6 may bear the same force, thereby enhancing the fixing of the circuit carrier 1. The non-metal fixing member 6 may be made of plastic material or other materials to reduce the interference of the non-metal fixing member 6 to the balanced dipole unit circuit 4.

In addition, for the balanced dipole unit provided by the embodiment above, the balanced dipole unit circuit 4 is provided with a plurality of open slots 7, and the plurality of open slots 7 arranged on the balanced dipole unit circuit 4 are symmetrically distributed on the circuit carrier 1. As shown in FIG. 4, two open slots 7 are arranged on the second circuit portion 42 of the balanced dipole unit circuit 4, and the two open slots 7 are symmetrically distributed on the circuit carrier 1.

The open slot 7 may be arranged on the balanced dipole unit circuit 4 through etching or other methods, and the symmetrically distributed open slot 7 may change the current distribution on the balanced dipole unit circuit 4, thus adding one to two new resonance frequency points based on an original resonance frequency point of the balanced dipole unit circuit 4, and increasing a working bandwidth of the broadband omnidirectional collinear array antenna formed by the balanced dipole unit through the original resonance frequency point and the new resonance frequency point, for example, through the design to the open slot 7, a frequency band covered by the working bandwidth of the broadband omnidirectional collinear array antenna may include but is not limited to a VHF (Very High Frequency) band of 138 MHz (megahertz) to 174 MHz, a UHF (Ultra High Frequency) band of 380 MHz to 512 MHz, and a cellular band of 746 MHz to 960 MHz. In the embodiment, a shape of the open slot 7 arranged on the balanced dipole unit circuit 4 is a shape of a Chinese character "[illegible]", an inverted T shape or a shape of a "±", so as to increase new resonance frequency point.

It needs to be noted here that symmetrical distribution refers to the symmetrical distribution between the open slots 7, as shown in FIG. 4, the two open slots 7 arranged in the second circuit portion 42 are symmetrically distributed based on the center point of the circuit carrier 1, FIG. 4 is merely an exemplary illustration, and the open slots 7 may further be symmetrical distributed through other methods. Certainly, in addition to the symmetrical distribution between the open slots 7, the single open slot 7 may also be a symmetrical distributed slot, and as shown in FIG. 4, the open slot 7 is symmetrical based on an axis of the circuit carrier 1.

In addition, the embodiment further provides a broadband omnidirectional collinear array antenna, which includes a metal supporting member, a non-metal fixing member and at least two balanced dipole units, wherein a structure of each balanced dipole unit in the at least two balanced dipole units is shown in FIG. 1 and FIG. 2, the balanced dipole unit is fixed on the metal supporting member through the non-metal fixing member, and specifically, the circuit carrier in the balanced dipole unit is fixed on the metal supporting member through the non-metal fixing member, the fixation refers to the relevant illustration in FIG. 3 and FIG. 4, which is not repeated in the embodiment. Alternatively, the broadband omnidirectional collinear array antenna provided in the embodiment includes at least two balanced dipole units, wherein the structure of each balanced dipole unit in the at least two balanced dipole units is shown in FIG. 3 and FIG. 4, and the metal supporting member included in each balanced dipole unit constitutes the metal supporting member of the broadband omnidirectional collinear array antenna.

Figure 5:
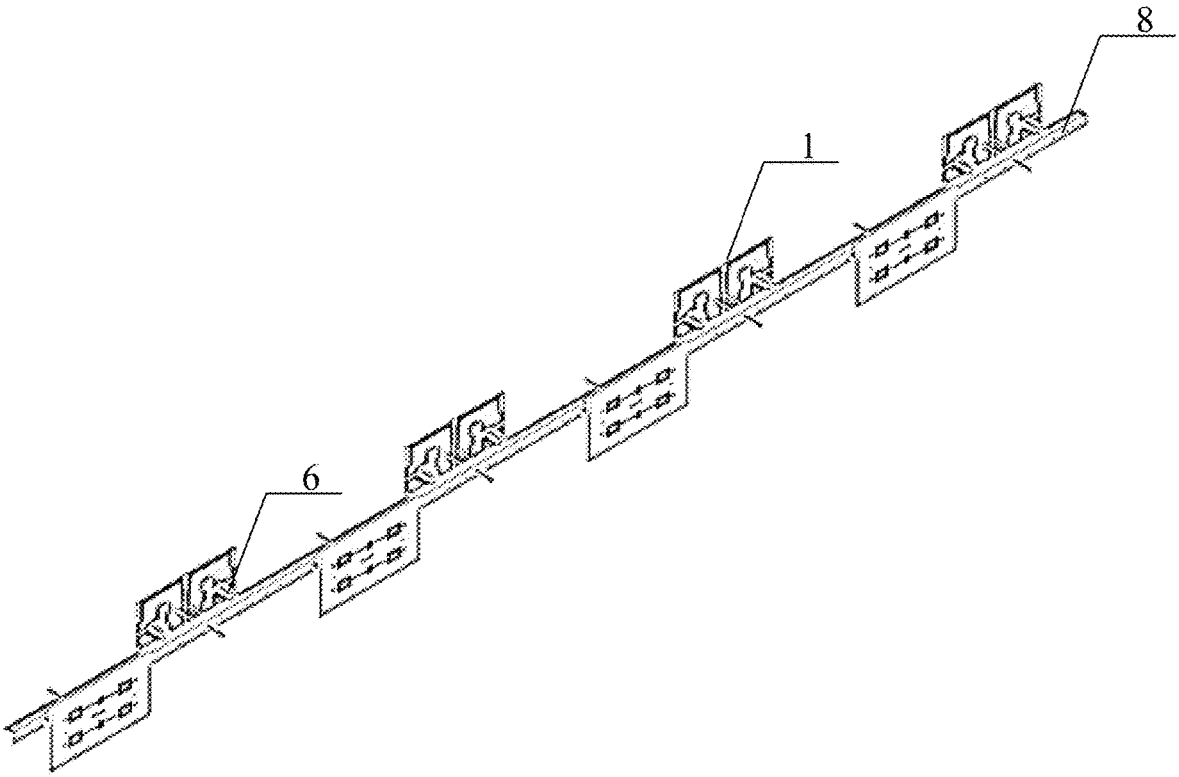
FIG. 5 is a structure diagram of a broadband omnidirectional collinear array antenna formed by eight balanced dipole units provided by an embodiment of the present invention.
Figure 6:
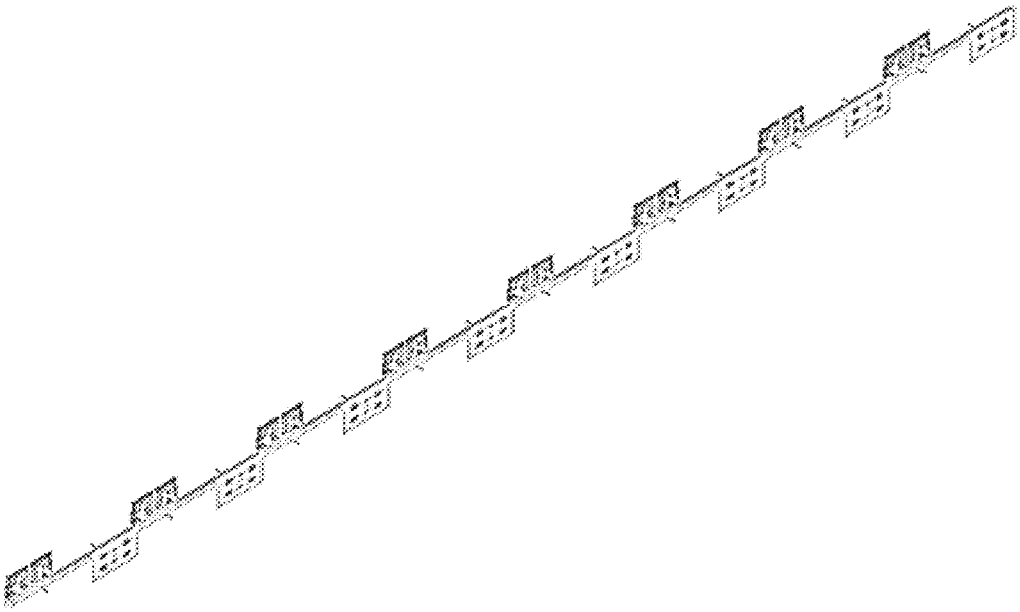
FIG. 6 is a structure diagram of a broadband omnidirectional collinear array antenna formed by 16 balanced dipole units provided by an embodiment of the present invention.

A number of the balanced dipole units included in the broadband omnidirectional collinear array antenna may be determined according to the antenna gain requirement of the broadband omnidirectional collinear array antenna, after selecting the balanced dipole unit that meets the antenna gain requirement, the selected balanced dipole unit is assembled, for example, when the structure of the balanced dipole unit in the broadband omnidirectional collinear array antenna is shown in FIG. 1 and FIG. 2, the selected balanced dipole unit is fixed on the metal supporting member through the non-metal fixing member, if the structure of the balanced dipole unit in the broadband omnidirectional collinear array antenna is shown in FIG. 3 and FIG. 4, one end of the metal supporting member in one balance dipole unit and one end of the metal supporting member in the other balance dipole unit in the selected balance dipole units are fixed together to obtain the broadband omnidirectional collinear array antenna, and then the broadband omnidirectional collinear array antenna corresponding to different antenna gain requirements is obtained through the assembly method of the balance dipole unit, and as shown in FIG. 5 and FIG. 6, FIG. 5 shows the broadband omnidirectional collinear array antenna formed by 8 balanced dipole units, and FIG. 6 shows the broadband omnidirectional collinear array antenna formed by 16 balance dipole units.

When the broadband omnidirectional collinear array antenna is formed by the balanced dipole unit, a spacing between each balanced dipole unit in the broadband omnidirectional collinear array antenna is the same or different, that is, when the broadband omnidirectional collinear array antenna is constituted, two adjacent balanced dipole units may be separated through a preset distance, so that the spacing between each balanced dipole unit in the broadband omnidirectional collinear array antenna is the same, and the preset distance may be determined according to a working wavelength of the broadband omnidirectional collinear array antenna, for example, the present distance may be, but is not limited to 0.75 times the working wavelength of the broadband omnidirectional collinear array antenna. Alternatively, when the broadband omnidirectional collinear array antenna is constituted, two adjacent balanced dipole units may be separated through different distances, and it needs to be noted here that if at least a spacing between the two adjacent balanced dipole units is different from a spacing between other adjacent balanced dipole units, the spacing between each balanced dipole unit in the broadband omnidirectional collinear array antenna is considered to be different.

When the structure of the balanced dipole unit in the broadband omnidirectional collinear array antenna is shown in FIG. 1 and FIG. 2, the metal supporting member included in the broadband omnidirectional collinear array antenna may be a supporting member that may fix all the balanced dipole units in the broadband omnidirectional collinear array antenna; and however, when the structure of the balanced dipole unit in the broadband omnidirectional collinear array antenna is shown in FIG. 3 and FIG. 4, the metal supporting member of the broadband omnidirectional collinear array antenna is formed by the metal supporting member in each balanced dipole unit, and a feasible method thereof for constituting the metal supporting member of the broadband omnidirectional collinear array antenna may be that: the metal supporting members in two adjacent balanced dipole units in the metal supporting member of the broadband omnidirectional collinear array antenna are partially intersected, or the metal supporting members in two adjacent balanced dipole units in the metal supporting member of the broadband omnidirectional collinear array antenna are connected through the metal part.

When the broadband omnidirectional collinear array antenna is formed by the balanced dipole unit, an arrangement method of the circuit carriers in each balanced dipole unit relative to the metal supporting member of the broadband omnidirectional collinear array antenna may be that: the circuit carriers in each balanced dipole unit are symmetrically distributed around the metal supporting member of the broadband omnidirectional collinear array antenna or are asymmetrically on at least two sides of the metal supporting member of the broadband omnidirectional collinear array antenna. That is to say, the circuit carrier in a part of the balanced dipole units constituting the broadband omnidirectional collinear array antenna and the circuit carrier in the remaining part of the balanced dipole units constituting the broadband omnidirectional collinear array antenna are arranged on different sides of the metal supporting member of the broadband omnidirectional collinear array antenna. For example, the circuit carrier in a part of the balanced dipole units is arranged on a first side of the metal supporting member of the broadband omnidirectional collinear array antenna, and the circuit carrier in the remaining part of the balanced dipole units is arranged on a second side opposite to the first side of the metal supporting member of the broadband omnidirectional collinear array antenna, and when the circuit carrier is arranged, all the circuit carriers may be symmetrically or asymmetrically distributed on the metal supporting member of the broadband omnidirectional collinear array antenna.

For all the circuit carriers arranged on the metal supporting member of the broadband omnidirectional collinear array antenna, if two adjacent circuit carriers are symmetrically distributed on the metal supporting member of the broadband omnidirectional collinear array antenna, all the circuit carriers are considered to be symmetrically distributed on the metal supporting member of the broadband omnidirectional collinear array antenna, and in all the circuit carriers arranged on the metal supporting member of the broadband omnidirectional collinear array antenna, if at least one circuit carrier and the remaining circuit carriers, such as the adjacent circuit carrier in the remaining circuit carriers are asymmetrically distributed, all the circuit carriers may be considered to be asymmetrically distributed on the metal supporting member of the broadband omnidirectional collinear array antenna.

In the embodiment, a feasible method for arranging the circuit carriers in each balanced dipole unit around the metal supporting member of the broadband omnidirectional collinear array antenna is that: the circuit carriers in each balanced dipole unit are alternately arranged on at least two sides of the metal supporting member of the broadband omnidirectional collinear array antenna, and the so-called alternate arrangement on at least two sides of the metal supporting member of the broadband omnidirectional collinear array antenna means that the circuit carriers in the two adjacent balanced dipole units in the broadband omnidirectional collinear array antenna are located on different sides of the metal supporting member of the broadband omnidirectional collinear array antenna. As shown in FIG. 5, the circuit carriers 1 in each balanced dipole unit are alternately arranged on two sides of the metal supporting member 8 of the broadband omnidirectional collinear array antenna, that is, the circuit carriers 1 in the two adjacent balanced dipole units are on different sides of the metal supporting member 8 of the broadband omnidirectional collinear array antenna, and the circuit carriers 1 are fixed on the metal supporting member 8 of the broadband omnidirectional collinear array antenna through the non-metal fixing member 6.

Specifically, in FIG. 5, the circuit carrier 1 in one of the two adjacent balanced dipole units is on a first side of the metal supporting member 8 of the broadband omnidirectional collinear array antenna, and the circuit carrier 1 in the other balanced dipole unit is on a second side of the metal supporting member 8 of the broadband omnidirectional collinear array antenna opposite to the first side, so that the broadband omnidirectional collinear array antenna may radiate in two opposite directions.

Certainly, in additional to the method shown in FIG. 5, other methods may further be used, for example, the circuit carrier 1 in one of the two adjacent balanced dipole units is on the first side of the metal supporting member 8 of the broadband omnidirectional collinear array antenna, and the circuit carrier 1 in the other balanced dipole unit is on a third side of the metal supporting member 8 of the broadband omnidirectional collinear array antenna adjacent to the first side, so that the broadband omnidirectional collinear array antenna may radiate in two adjacent directions.

Figure 7:
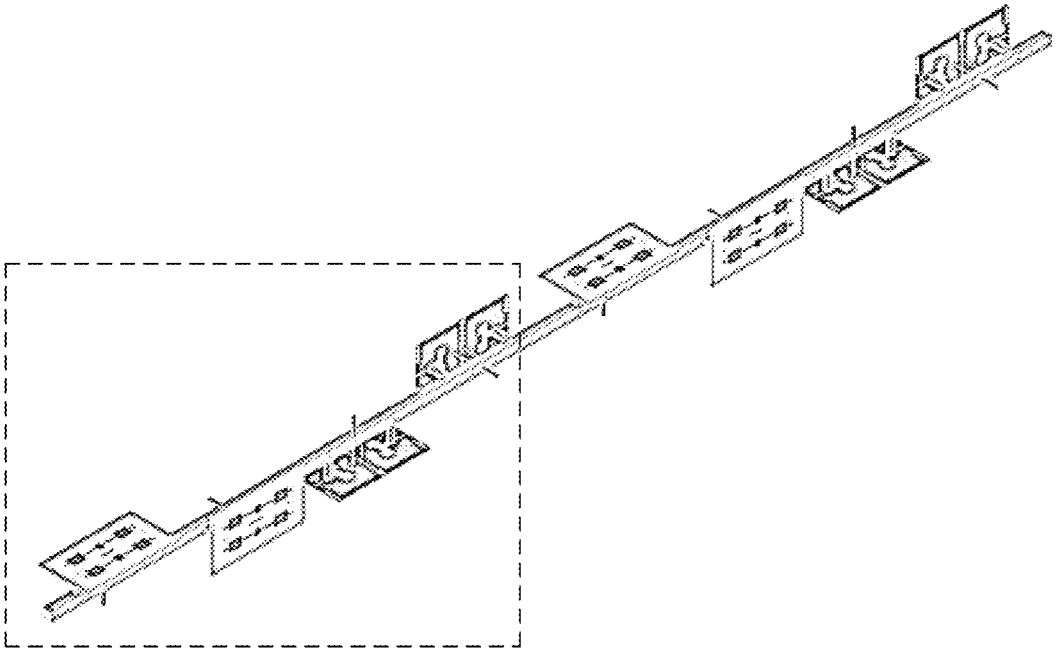
FIG. 7 is another structure diagram of the broadband omnidirectional collinear array antenna formed by 8 balanced dipole units provided by the embodiment of the present invention.

For another example, the method shown in FIG. 7 may further be used that the circuit carriers in each balanced dipole unit may be alternately arranged on at least two sides of the metal supporting member of the broadband omnidirectional collinear array antenna. In the method shown in FIG. 7, every four of the balanced dipole units in the broadband omnidirectional collinear array antenna form one group (as shown in a dotted box in FIG. 7), the circuit carriers in each balanced dipole unit in each group of balanced dipole units are alternately arranged on four sides of the metal supporting member of the broadband omnidirectional collinear array antenna, and an angle difference between the circuit carriers in two adjacent balanced dipole units in the same group of balanced dipole units and the metal supporting member of the broadband omnidirectional collinear array antenna is 90 degrees.

If a first balanced dipole unit in the four balanced dipole units of the same group arranged on the metal supporting member of the broadband omnidirectional collinear array antenna is used for reference, the remaining three balanced dipole units respectively rotate by 90 degrees, 180 degrees and 270 degrees (all the balanced dipole units rotate counterclockwise or clockwise) relative to the first balanced dipole unit, so that the circuit carriers in the balanced dipole units may be alternately arranged on four sides of the metal supporting member of the broadband omnidirectional collinear array antenna, and the angle difference between the circuit carriers in two adjacent balanced dipole units and the metal supporting member of the broadband omnidirectional collinear array antenna is 90 degrees, so that the broadband omnidirectional collinear array antenna may radiate in four directions.

Certainly, when the circuit carriers in each balanced dipole unit are arranged around the metal supporting member of the broadband omnidirectional collinear array antenna, the circuit carriers may also be arranged around one side or three sides of the metal supporting member of the broadband omnidirectional collinear array antenna, when the circuit carriers are arranged around one side, the circuit carriers may be arranged symmetrically or asymmetrically on one side, and when the circuit carriers are arranged around three sides, the circuit carriers may be arranged with reference to the method shown in FIG. 7 above, which is not repeated in the embodiment, so that the broadband omnidirectional collinear array antenna may radiate in different directions.

When the broadband omnidirectional collinear array antenna is formed by the balanced dipole unit, another arrangement method of the circuit carriers in each balanced dipole unit relative to the metal supporting member of the broadband omnidirectional collinear array antenna may be that: the metal supporting member of the broadband omnidirectional collinear array antenna includes at least two supporting portions, two adjacent supporting portions in the at least two supporting portions are connected through a metal part, each supporting portion corresponds to at least one balanced dipole unit in the broadband omnidirectional collinear array antenna, and orientations of the balanced dipole units corresponding to different supporting portions are different. The following description takes the broadband omnidirectional collinear array antenna shown in FIG. 8 as an example.

Figure 8:
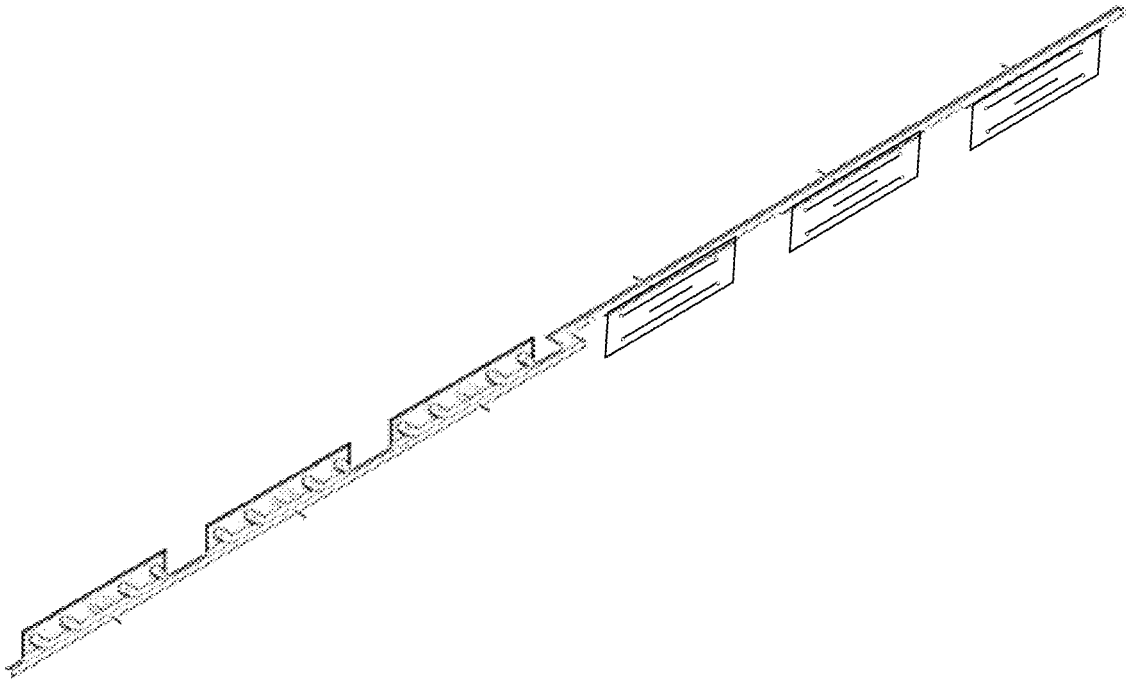
FIG. 8 is a structure diagram of a broadband omnidirectional collinear array antenna formed by 6 balanced dipole units provided by an embodiment of the present invention.

As shown in FIG. 8, the metal supporting member of the broadband omnidirectional collinear array antenna includes two supporting portions, which are respectively regarded as a first supporting portion and a second supporting portion of the metal supporting member of the broadband omnidirectional collinear array antenna, wherein the first supporting portion and the second supporting portion are connected up and down through the metal part, which means that the first supporting portion and the second supporting portion in the metal supporting member of the broadband omnidirectional collinear array antenna are not on the same straight line, the first supporting portion corresponds to three balanced dipole units in the broadband omnidirectional collinear array antenna, the second supporting portion corresponds to the remaining three balanced dipole units in the broadband omnidirectional collinear array antenna, and the orientation of the balance dipole unit corresponding to the first supporting portion is different from that of the balance dipole unit corresponding to the second supporting portion. As shown in FIG. 8, taking the orientation of the circuit carrier of the balanced dipole unit as an example, if the front of the circuit carrier corresponding to the first supporting portion faces outward and the back of the circuit carrier corresponding to the second supporting portion faces outward, the broadband omnidirectional collinear array antenna may also radiate in two directions.

Figure 9:
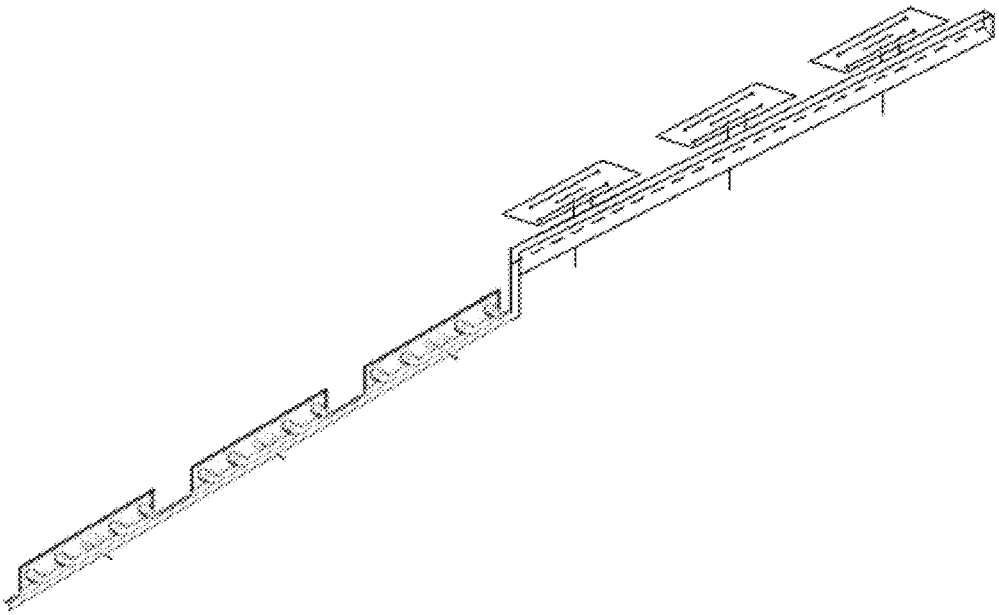
FIG. 9 is another structure diagram of the broadband omnidirectional collinear array antenna formed by 6 balanced dipole units provided by the embodiment of the present invention.

When the broadband omni-directional collinear array antenna is constituted based on the method shown in FIG. 8, in addition to the different orientations of the balanced dipole units corresponding to the different supporting portions, the balanced dipole units corresponding to two adjacent supporting portions may have a certain angle. As shown in FIG. 9, an included angle of 90 degrees may be formed between the balance dipole units corresponding to the two adjacent supporting portions, which may also be an included angle of other degrees, which is not repeated in the embodiment.

Figure 10:
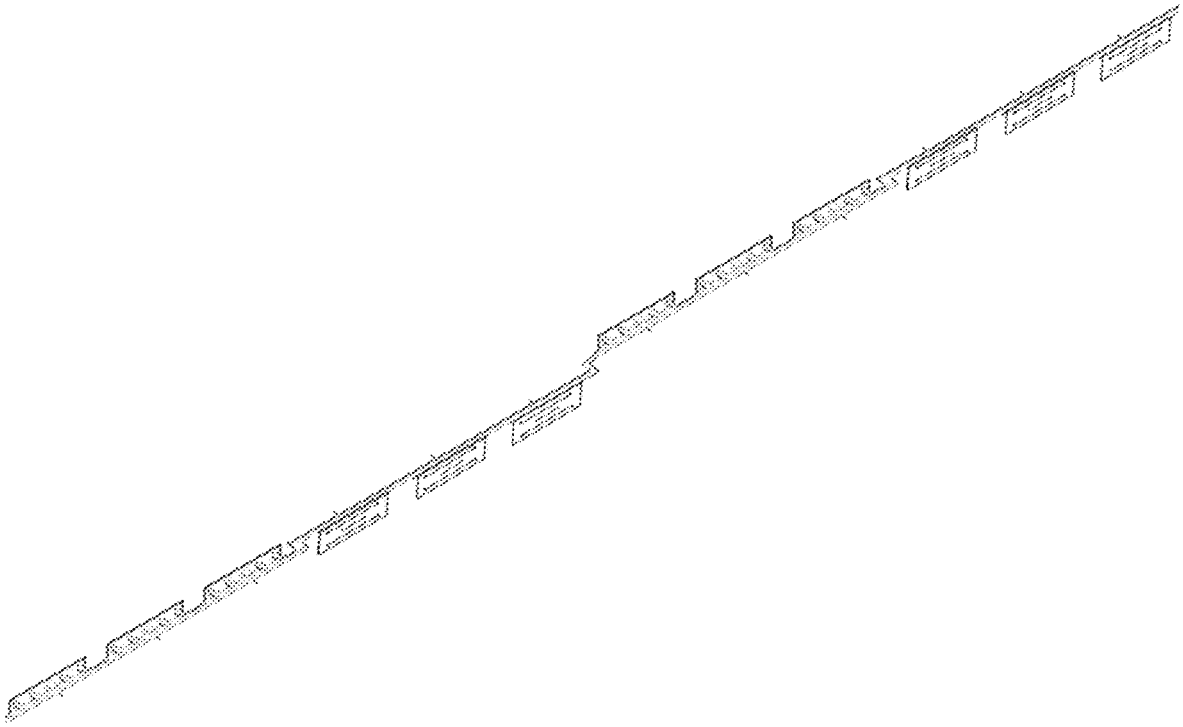
FIG. 10 is another structure diagram of a broadband omnidirectional collinear array antenna formed by 12 balanced dipole units provided by an embodiment of the present invention.

It shall be noted here that the broadband omnidirectional collinear array antenna shown in FIG. 8 and FIG. 9 is merely an example, the broadband omnidirectional collinear array antenna provided in the embodiment may further use the arrangement method shown in FIG. 8 and FIG. 9 to constitute the broadband omnidirectional collinear array antenna with the antenna gain different from that shown in FIG. 8 and FIG. 9. If 12 balanced dipole units may be selected and the method shown in FIG. 8 is used to constitute the broadband omnidirectional collinear array antenna shown in FIG. 10, the orientations of the balanced dipole units corresponding to two adjacent supporting members are different in the broadband omnidirectional collinear array antenna shown in FIG. 10.

In the broadband omnidirectional collinear array antenna above, the broadband omnidirectional collinear array antenna provided in the embodiment further includes a signal feeder and a power divider, wherein the signal feeder is configured to feed a radio frequency signal, and the power divider is configured to divide the radio frequency signal to each balanced dipole unit. That is to say, the radio frequency signal is transmitted to each balanced dipole unit of the broadband omnidirectional collinear array antenna through the power divider in the broadband omnidirectional collinear array antenna, and the radio frequency signal transmitted to each balanced dipole unit is fed through the signal feeder, wherein the signal feeder is connected to the feeder in each balanced dipole unit to feed the radio frequency signal received by the balanced dipole unit through the feeder in the balanced dipole unit, thereby radiating the radio frequency signal through the balanced dipole unit.

For the metal supporting member of the broadband omnidirectional collinear array antenna, a first end of the metal supporting member of the broadband omnidirectional collinear array antenna is provided with a feed port for connecting the signal feeder, so as to access the signal feeder through the feed port; and a second end of the metal supporting member of the broadband omnidirectional collinear array antenna is provided with a lightning protection element, so that the metal supporting member of the broadband omnidirectional collinear array antenna can not only be used as a support for the collinear array antenna, but also be used as a part of a lightning protection circuit in the broadband omnidirectional collinear array antenna to prevent lightning strike on the broadband omnidirectional collinear array antenna and protect the broadband omnidirectional collinear array antenna. For example, the broadband omnidirectional collinear array antenna can withstand a lightning current of 150 kA (pulse: 10/350 μs) through the lightning protection element, which meets the requirement of Class-II lightning protection according to provisions of parts 1 to 4 of IEC 62305 and VDE 0855-300 standard.

Figure 11:
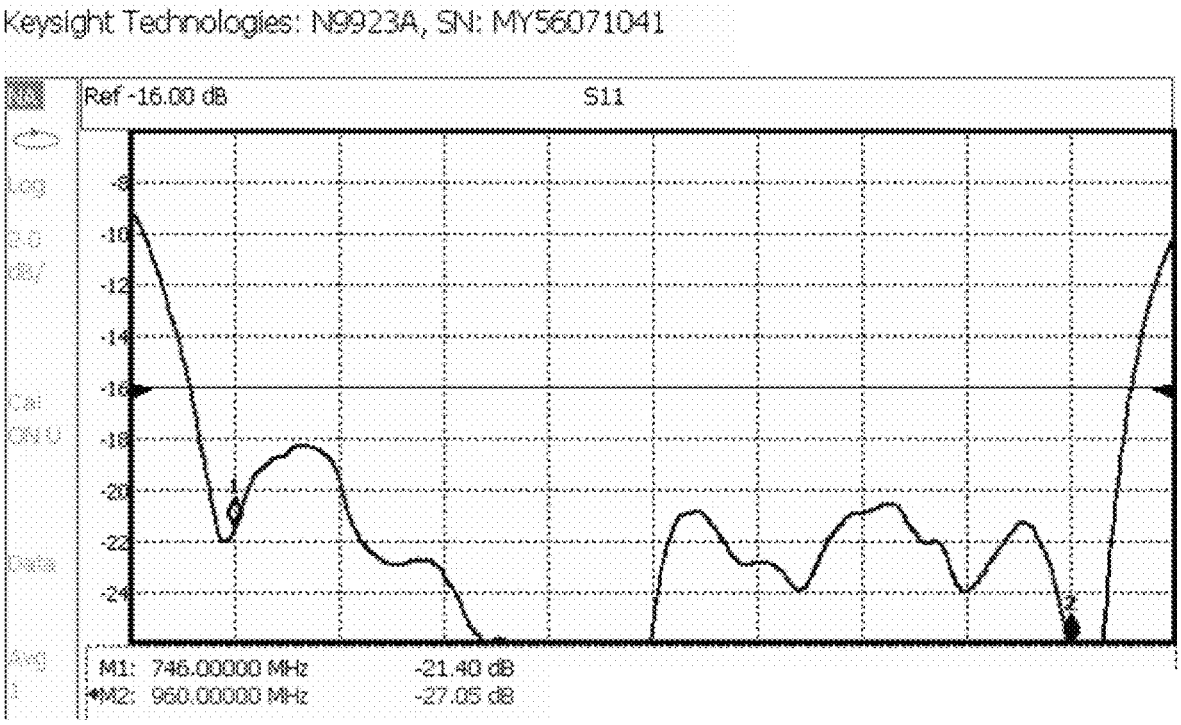
FIG. 11 is an actual test result diagram of a return loss of the broadband omnidirectional collinear array antenna shown in FIG. 6 and provided by the embodiment of the present invention.

In order to explain the effect of the broadband omnidirectional collinear array antenna provided in the embodiment, an actual test result diagram of a return loss is provided. FIG. 11 shows actual test result diagram of the return loss of the broadband omnidirectional collinear array antenna shown in FIG. 6, and it can be known from the actual test result diagram of the return loss that the working bandwidth of the broadband omnidirectional collinear array antenna provided in the embodiment is significantly improved.

It needs to be stated that the various embodiments in the description are described in a progressive manner, each embodiment focuses on the differences from other embodiments, and the same and similar parts among the various embodiments can be seen from each other.

Finally, it further needs be noted that in the text, relational terms such as first and second are only used to distinguish one entity or operation from another entity or operation, and do not necessarily require or imply any such actual relationship or order between these entities or operations. Moreover, the terms "comprise", "contain" or any other variations thereof are intended to cover a non-exclusive inclusion, so that a device includes not only those elements but also other elements not expressly listed, or further includes inherent elements to the device. Without further restrictions, the elements defined by the statement "comprise one . . . " do not exclude the existence of other identical elements in the included device.

The foregoing description of the disclosed embodiments enables those skilled in the art to achieve or use the present invention. The various modifications to these embodiments will be apparent to those skilled in the art, and the general principles defined herein may be implemented in other embodiments without departing from the spirit or scope of the present invention. Therefore, the present invention will not be limited to these embodiments shown herein, and shall have a widest scope consistent with the principles and novel features disclosed herein.

The foregoing is merely the preferred embodiments of the present invention, and it shall be noted that those skilled in the art may further make a plurality of improvements and decorations without departing from the principle of the present invention, and these improvements and decorations shall also fall within the protection scope of the invention.

The invention claimed is:

1. A balanced dipole unit, wherein the balanced dipole unit comprises: a circuit carrier having a front side and an opposite back side, a balanced dipole unit circuit, a feeder and a ground wire;

the balanced dipole unit circuit is symmetrically distributed on both front and back sides of the circuit carrier; and the feeder and the ground wire are connected to the balanced dipole unit circuit, and the feeder and the ground wire are symmetrically distributed to each other in the balanced dipole unit.

2. The balanced dipole unit according to claim 1, wherein the balanced dipole unit circuit is provided with a plurality of open slots, and the open slots arranged on the balanced dipole unit circuit are symmetrically distributed on the circuit carrier.

3. The balanced dipole unit according to claim 1, wherein the balanced dipole unit further comprises a metal supporting member and a non-metal fixing member; and the circuit carrier and the metal supporting member are connected through the non-metal fixing member.

4. The balanced dipole unit according to claim 3, wherein a number of the non-metal fixing member is at least one, and the circuit carrier is connected to the metal supporting member through at least one non-metal fixing member.

5. The balanced dipole unit according to claim 4, wherein when the number of the non-metal fixing member is at least two, at least two non-metal fixing members are symmetrically arranged in the balanced dipole unit.

6. The balanced dipole unit according to claim 1, wherein a printed circuit board or a metal stamping part is used as the circuit carrier.

7. The balanced dipole unit according to claim 2, wherein the balanced dipole unit further comprises a metal supporting member and a non-metal fixing member; and the circuit carrier and the metal supporting member are connected through the non-metal fixing member.

8. The balanced dipole unit according to claim 1, wherein the balanced dipole unit further comprises a metal supporting member and a non-metal fixing member; and the circuit carrier and the metal supporting member are connected through the non-metal fixing member.

9. A broadband omnidirectional collinear array antenna, comprising a metal supporting member, a non-metal fixing member and at least two balanced dipole units according to claim 1, wherein the balanced dipole unit is fixed on the metal supporting member through the non-metal fixing member.

10. The broadband omnidirectional collinear array antenna according to claim 9, wherein circuit carriers in each balanced dipole unit are symmetrically distributed around the metal supporting member of the broadband omnidirectional collinear array antenna or are asymmetrically on at least two sides of the metal supporting member of the broadband omnidirectional collinear array antenna.

11. The broadband omnidirectional collinear array antenna according to claim 10, wherein the circuit carriers in each balanced dipole unit are alternately arranged on at least two sides of the metal supporting member of the broadband omnidirectional collinear array antenna.

12. The broadband omnidirectional collinear array antenna according to claim 11, wherein every four of the balanced dipole units in the broadband omnidirectional collinear array antenna form one group, the circuit carriers in each balanced dipole unit in each group of balanced dipole units are alternately arranged on four sides of the metal supporting member of the broadband omnidirectional collinear array antenna, and an angle difference between the circuit carriers in two adjacent balanced dipole units in the same group of balanced dipole units and the metal supporting member of the broadband omnidirectional collinear array antenna is 90 degrees.

13. The broadband omnidirectional collinear array antenna according to claim 9, wherein the metal supporting member of the broadband omnidirectional collinear array antenna comprises at least two supporting portions, two adjacent supporting portions in the at least two supporting portions are connected through a metal part, each supporting portion corresponds to at least one balanced dipole unit in the broadband omnidirectional collinear array antenna, and orientations of the balanced dipole units corresponding to different supporting portions are different.

14. The broadband omnidirectional collinear array antenna according to claim 9, wherein a spacing between each balanced dipole unit in the broadband omnidirectional collinear array antenna is the same or different.

15. The broadband omnidirectional collinear array antenna according to claim 9, wherein the broadband omnidirectional collinear array antenna further comprises a signal feeder and a power divider, wherein the signal feeder is configured to feed a radio frequency signal, and the power divider is configured to divide the radio frequency signal to each balanced dipole unit.

16. The broadband omnidirectional collinear array antenna according to claim 15, wherein a first end of the metal supporting member of the broadband omnidirectional collinear array antenna is provided with a feed port for connecting the signal feeder, and a second end of the metal supporting member of the broadband omnidirectional collinear array antenna is provided with a lightning protection element.

17. The broadband omnidirectional collinear array antenna according to claim 9, wherein in the case that the metal supporting member included in each of the balanced dipole units constitutes the metal supporting member of the broadband omnidirectional collinear array antenna, the metal supporting members in two adjacent balanced dipole units in the metal supporting member of the broadband omnidirectional collinear array antenna are partially intersected, or the metal supporting members in two adjacent balanced dipole units in the metal supporting member of the broadband omnidirectional collinear array antenna are connected through the metal part.

18. The broadband omnidirectional collinear array antenna according to claim 9, wherein a number of the balanced dipole unit is determined according to an antenna gain requirement of the broadband omnidirectional collinear array antenna.

* * * * *